United States Patent [19]

Itano

[11] 3,956,837

[45] May 18, 1976

[54] DISPLAY FRAME

[76] Inventor: Takeo Itano, 6459 N. Wayne Ave., Chicago, Ill. 60626

[22] Filed: Sept. 20, 1974

[21] Appl. No.: 507,854

[52] U.S. Cl. ..... 40/152.1; 40/10 D
[51] Int. Cl.[2] ..... G09F 1/12
[58] Field of Search ..... 248/473; 40/152.1, 10 D

[56] References Cited

UNITED STATES PATENTS

| | | | |
|---|---|---|---|
| 1,220,418 | 3/1917 | Hawkes | 40/156 |
| 2,588,545 | 3/1952 | Lawrence | 40/152.2 |
| 2,747,311 | 5/1956 | Fulmer | 40/156 |
| 2,807,369 | 9/1957 | Stark | 40/152.1 X |
| 3,820,262 | 6/1974 | Dewsnap | 40/10 D |

*Primary Examiner*—Hugh R. Chamblee
*Assistant Examiner*—Wenceslao J. Contreras
*Attorney, Agent, or Firm*—Berman, Aisenberg & Platt

[57] ABSTRACT

A pair of frame elements, between which a photograph is held, are preferably formed of a clear, transparent plastic material, each frame element having a flat horizontal bottom portion and an upwardly directed, sheet-like portion. To the underside of the box of the front frame element are fixed a pair of spaced guide strips which extend beyond the upwardly directed portion and rearwardly, while a second pair of similarly formed guide strips extends forwardly from the underside of the base of the rear frame element. The guide strips engage each other in sliding contact when the front and rear frame elements are pushed together to clamp the photograph. In addition it is desirable to provide on the underside of each base a downward projection, about which projections an elastic band is stretched to hold the photograph releasably clamped between the front and rear frame elements.

9 Claims, 6 Drawing Figures

FIG. 1.
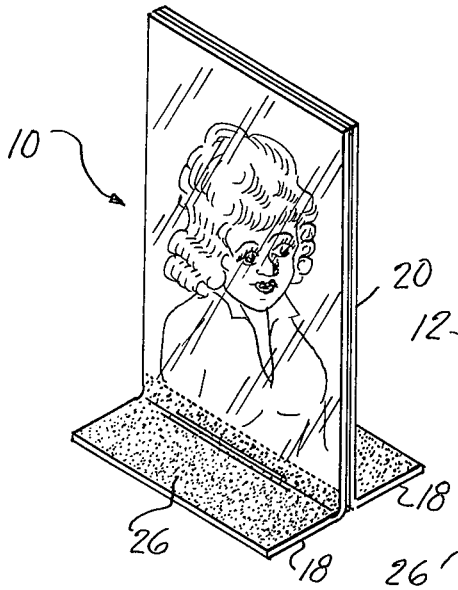
FIG. 2.
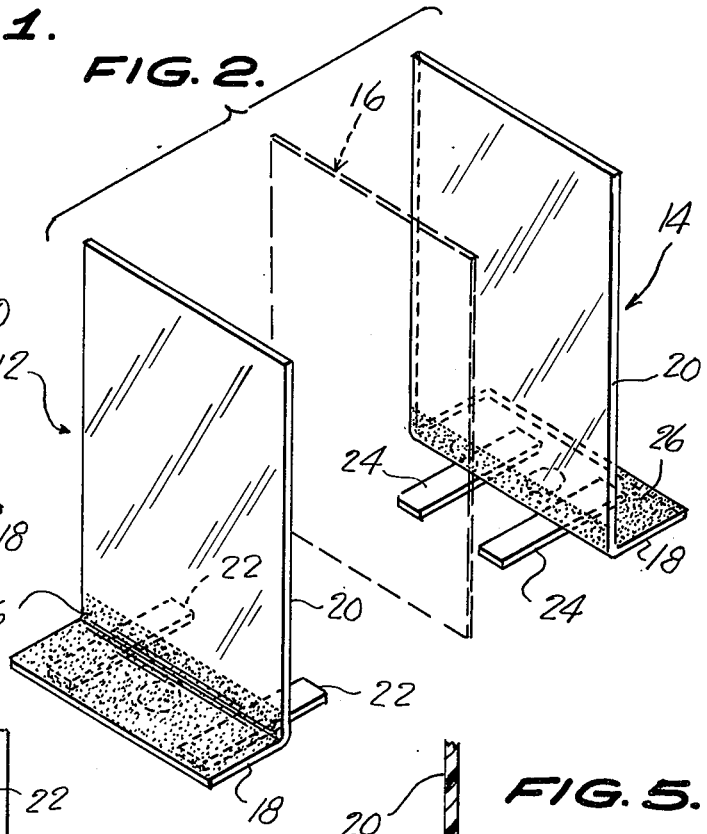
FIG. 3.
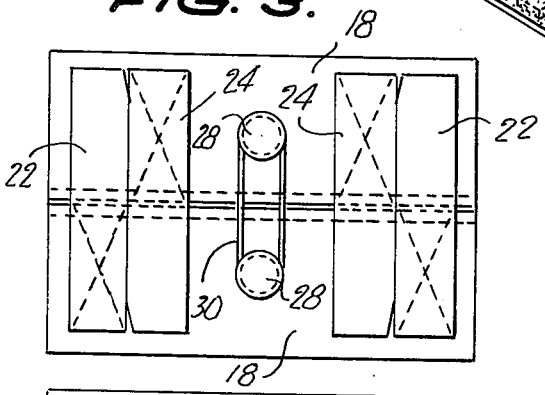
FIG. 5.
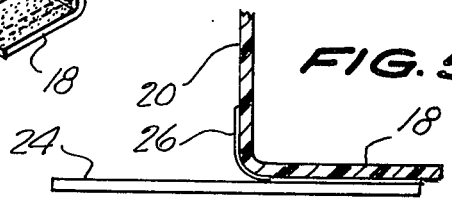
FIG. 6.
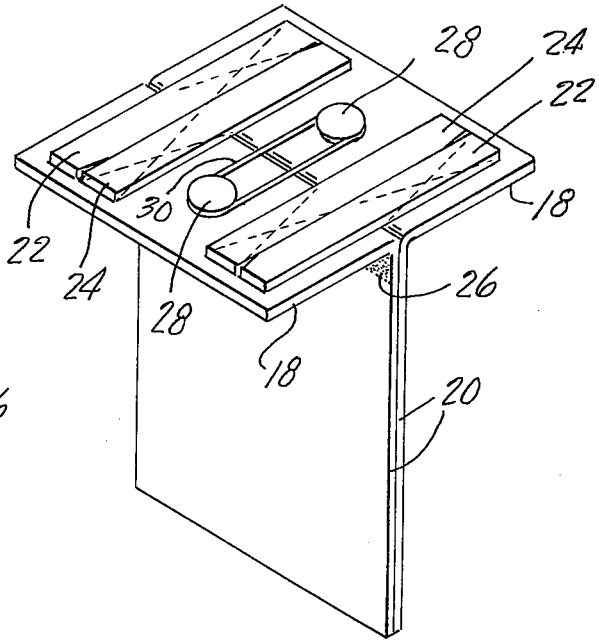
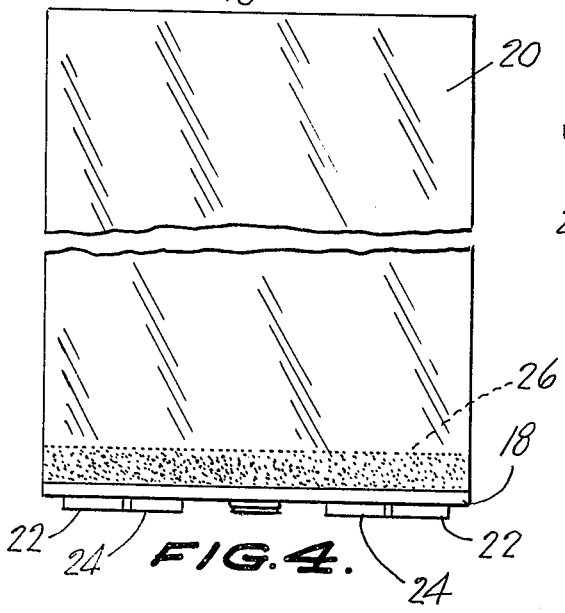
FIG. 4.

DISPLAY FRAME

BACKGROUND OF THE INVENTION

This invention relates to a display frame suitable for photographs, art materials, advertising, signs, price legends, and the like.

The most conventional frames for displaying photographs, and similar items, are of complex construction each involving a four-sided frame, a backing sheet and a front glass panel, the frame having a relatively complicated structural design to receive the backing panel and the front glass panel. In addition a hinged element is usually added, which is turnable to hold the frame in upright position on a desk, or table top. Such frames are expensive to fabricate, difficult to assemble and disassemble, and subject to the objection that they do not permit the viewing of the photograph, or other display material, from two opposite sides.

SUMMARY OF THE INVENTION

The present invention seeks to overcome the above-mentioned disadvantages of conventional frames, and to provide a simplified structure including front and rear frame members, of transparent material, each formed of an upstanding panel integral with a flat, horizontal base portion. The described front and rear frame members are identical and may be pushed together to clamp a sheet of display material between the upstanding panels, without further additions to the structure. However, in the preferred embodiment, each frame member is provided with a pair of spaced guide strips which project from the underside of the base portion of the frame member to slidingly engage the similar pair of guide strips on the other frame member. This prevents lateral and vertical separation of one frame member from the other. As a further securing means of the assembled frame members with the display material, a projection in the form of a disc is formed or added to the underside of the base portion of each frame member and an elastic band is stretched over the two discs in order to positively, and releasably, secure the two frame members together with the display material clamped between them.

Accordingly it is a primary object of the present invention to provide a display frame, having the above described characteristics, which, if desired, requires no fastening elements, but in a preferred embodiment utilizes merely an elastic band to releasably hold the frame members and the display material together.

It is another important object of the invention to provide a display frame, having the above described characteristics, which is adjustable in its assembly to hold pictures or display material of varying thickness.

Another object of the invention is to provide a display frame, having the above described characteristics, whose use permits the viewing of the display from opposite sides, rather than from one side only.

Still another object of the invention is to provide a display frame, having the above described characteristics, which is easy to assemble and to disassemble, and wherein upon disassembly the photograph, or other display material, is quickly removable rendering the inside surfaces of the transparent panels of the front and rear frame members readily cleanable.

A still further object of the invention is to provide a display frame, having the above described characteristics, which is of artistic and pleasing appearance, and yet has a very simple structure, easy to fabricate and economical to produce.

The novel features that are considered characteristic of the invention are set forth with particularity in the appended claims. The invention itself, however, both as to its organization and advantages thereof, will best be understood from the following description of a specific embodiment, when read in connection with the accompanying drawing, wherein like reference characters indicate like parts throughout the several Figures, and in which:

FIG. 1 is a perspective view of a display frame, according to the invention, assembled with a photograph and showing the assembly as viewed from the front and one side;

FIG. 2 is an exploded perspective view of the display frame shown in FIG. 1;

FIG. 3 is a bottom plan view of the frame;

FIG. 4 is a front elevation of the frame omitting the display photograph;

FIG. 5 is an enlarged fragmentary sectional view through the lower part of the rear frame element; and FIG. 6 is a perspective view of the assembled frame as viewed in upside-down condition.

DESCRIPTION OF THE PREFERRED EMBODIMENT

Referring now to the drawings, a preferred display frame is illustrated in FIG. 1 in assembled condition with a photograph clamped between front and rear elements. The frame generally referenced 10 comprises a front frame member 12 and a rear member 14 shown separated in the exploded view, FIG. 2. In this figure the photograph, or display material, is labelled 16.

Members 12 and 14 identically comprise a flat, horizontal base portion 18 integrally formed at the bottom of an upwardly-directed, flat, sheet-like portion 20. Desirably these members are formed of a clear, transparent plastic material so that when the display material 16 is held between the frame members 12 and 14 pushed together, photographs, or legends, on opposite sides of the display material are visible from opposite sides of the assembly through the transparent panels 20. Although the frame members, as thus described, are operative to securely hold the display on a desk, or table top, by weight and by friction of the base portions 18 against the desk surface, it is preferred to provide a pair of spaced guide strips 22 on the forward frame member and a similar pair of guide strips 24 on the rear frame member. Guide elements 22, 24 are desirably formed of the same plastic material as the frame members 12 and 14 and are suitably adhered to the bottom surfaces of portions 18, by heat, cement, glue or other adhesive substances. The strips 22 and 24 are preferably of equal size and the former project rearwardly from the front frame member 12, while the latter project forwardly from the rear frame member 14, being so arranged that they slidingly engage each other when the frame members are pushed together. Such engagement prevents vertical and lateral displacements of one frame member with respect to the other. In order to hide the guide elements and improve the appearance of the assembled frame, it is desirable to provide an opaque coating 26 on the base members 18. While such coating may be applied as a paint or enamel, or may be chemically formed as a layer on the upper surfaces of the base portions 18, it is preferred to apply, or form the coatings on the lower surfaces of the base portions 18 before the guide strips 22, 24 are secured. Desirably, as best seen in FIGS. 1, 2, and 5, the coating 26 is extended slightly above the bottoms of the upwardly directed portions 20 of the front and rear frame members.

To further insure that the assembled front and rear frame elements with the display material clamped therebetween will remain assembled until such time as it is desired to separate them for changing the photograph or cleaning the interior surfaces of the panels 20, each base portion 18 has secured centrally to the underside thereof a frusto-conical projection 28. Desirably these projections are formed of the same plastic material as the frame members and easily secured by heat, or by suitable adhesion means. The projections have the appearance of discs with bevelled circumferential edges which are tapered inwardly and upwardly. Over these projections is stretched an elastic band of rubber, or other suitable material, such as 30. The band securely clamps the front and rear frame members and the display material 16 together, but may be easily stretched and removed from the projections 28 to permit the ready separation of the frame members from the display material.

The mode of utilizing the above described display frame is considered to be obvious from the description above. Briefly a sheet of material 16 to be displayed having legends on both sides, or a single photograph, or two photographs are merely placed between the front and rear members 12, 14 which are then pushed together to clamp the display material with the guide elements 22, 24 slidingly engaging each other to properly locate the frame members with respect to the display material. These assembled parts, while being held together, may be tilted, or even inverted, and an elastic band 30 stretched over the projections 28 to releasably secure the parts together. The assembled display frame may then be retilted or reinverted and disposed with the undersides of guide strips 22, 24 and projections 28 seated on a table, desk, or counter top.

When it is desired to change the photograph or display, or to clean the internal surfaces of the frame members and particularly the upwardly directed panels 20, it is merely necessary to tilt, or invert the frame to a position such as illustrated in FIG. 6, expand the rubber band 30 and remove it from the projections 28, and then pull the frame members 12 and 14 in opposite directions to separate them from the display material 16.

While both frame members 12, 14 have been described as being identically formed of a transparent plastic material, it is apparent that one of them may be formed of a non-transparent material in which case the display can be viewed only through the other and from one side. As has also been previously indicated, the opaque coating 26, the guide strips, 22, 24, the projections 28 and the elastic band 30, individually or all may be omitted, if so desired, while the remaining parts would still function for their intended purpose, although with less efficiency.

It should be noted that in FIGS. 3 and 6, the portions of the guide strips 22, 24 which are bonded to the base portions 18 of the frame, either directly or under coating 26 are indicated by broken line X's.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. A display frame for a photograph, or the like, comprising a front frame member having a forwardly directed base protion and a flat, sheet-like, upwardly directed portion formed of transparent material, a rear frame member having a rearwardly directed base portion and a flat sheet-like, upwardly directed portion, a first guide element secured to the underside of the base portion and extending rearwardly beyond the upwardly directed portion of the front frame member, a second guide element secured to the underside of the base portion and extending forwardly of the upwardly directed portion of the rear frame member, a third guide element secured to the underside of the base portion of the front frame member and being spaced from the first guide element, a fourth guide element secured to the underside of the base portion of the rear frame member and spaced from the second guide element, said first and second guide elements and said third and fourth guide elements making sliding engagement with each other respectively when the front and rear frame members are pushed toward one another so as to hold a photograph between their respective flat, upwardly directed portions.

2. A display frame according to claim 1, wherein a coating of opaque material is adhered to cover the base portion of said front frame member.

3. A display frame according to claim 2, wherein said coating of opaque material is applied to the underside of the base of said front frame member

4. A display frame according to claim 1, wherein said upwardly directed portion of the rear frame member is formed of transparent material.

5. A display frame according to claim 4, wherein a coating of opaque material is adhered to cover the undersides of both said base portions to hide said guide elements.

6. A display frame according to claim 1, wherein said upwardly directed portion of said front and rear frame members are disposed in vertical planes.

7. A display frame according to claim 1 wherein said guide elements comprise flat strips.

8. A display frame for a photograph, or the like, comprising a front frame member having a forwardly directed base portion and a flat, sheet-like upwardly directed portion formed of transparent material, a rear frame member having a rearwardly directed base portion and a flat sheet-like upwardly directed portion, a first-guide element secured to the underside of the base portion and extending rearwardly beyond the upwardly directed portion of the front frame member, a second-guide element secured to the underside of the base portion and extending forwardly of the upwardly directed portion of the rear frame member, said first and second guide elements making sliding engagement with each other when the front and rear members are pushed toward one another so as to hold a photograph between their respective, flat upwardly directed portions, and wherein first and second projections are affixed to the undersides of the base portions respectively of said front and rear frame members, and an elastic band is stretched over said projections to releaseably clamp the front and rear frame members together.

9. A display frame according to claim 8, wherein each of said projections comprises a disc whose circumferential edge is bevelled slightly inwardly and upwardly, whereby to more certainly retain said elastic band while stretched over said discs.

* * * * *